US012715483B2

(12) United States Patent
Kress et al.

(10) Patent No.: US 12,715,483 B2
(45) Date of Patent: Aug. 25, 2026

(54) RAIL CAR MODULARIZED MODIFICATION PROGRAMS ALTERING THE NATURE OF THE CENTER SILL IN THE MODIFIED RAILCAR AND THE MODIFIED RAILCARS FORMED THEREBY

(71) Applicant: JAC Operations, Inc., Chicago, IL (US)

(72) Inventors: Michael H. Kress, Armagh, PA (US); Cloyd Wirick, Mineral Point, PA (US); Gregory P. Josephson, Salix, PA (US)

(73) Assignee: JAC OPERATIONS, INC., Chicago, IL (US)

( * ) Notice: Subject to any disclaimer, the term of this patent is extended or adjusted under 35 U.S.C. 154(b) by 526 days.

(21) Appl. No.: 18/207,823

(22) Filed: Jun. 9, 2023

(65) Prior Publication Data

US 2023/0399031 A1 Dec. 14, 2023

Related U.S. Application Data

(63) Continuation of application No. PCT/US2021/062932, filed on Dec. 10, 2021.

(60) Provisional application No. 63/123,584, filed on Dec. 10, 2020.

(51) Int. Cl.
*B61D 7/00* (2006.01)

(52) U.S. Cl.
CPC ..... *B61D 7/00* (2013.01)

(58) Field of Classification Search
CPC ..... B61D 7/00; B61F 1/02
See application file for complete search history.

(56) References Cited

U.S. PATENT DOCUMENTS

| | | | | |
|---|---|---|---|---|
| 2,589,996 A * | 3/1952 | Dean | ..... | B61F 1/10 105/420 |
| 3,238,899 A * | 3/1966 | Gutridge | ..... | B61F 1/02 105/422 |
| 3,527,171 A * | 9/1970 | Stark | ..... | B61F 1/00 105/404 |
| 3,577,934 A * | 5/1971 | Gutridge | ..... | B61F 1/04 105/413 |

(Continued)

FOREIGN PATENT DOCUMENTS

| | | | | |
|---|---|---|---|---|
| CA | 2745780 C * | 2/2014 | ..... | B61D 7/28 |
| WO | 1998/036957 | 8/1998 | | |

(Continued)

*Primary Examiner* — Jason C Smith
(74) *Attorney, Agent, or Firm* — Blynn L. Shideler; Krisanne Shideler; BLK Law Group

(57) ABSTRACT

Rail car modularized modification programs altering the nature of the center sill in the modified railcar yield a greater variety of car types that can be placed into service. The present invention provides method of modification of a railcar to form a modified railcar comprising the steps of: providing an existing railcar with a center sill design of one of i) a stub sill and ii) a through sill; removing an upper portion of the existing railcar; forming an underframe construction including bolsters configured to be above truck assemblies and coupled to the center sill design, and a center sill design of one of i) a stub sill ii) a through sill, and iii) a fish-belly center sill; forming an upper body of the modified railcar; and attaching the upper body of the modified railcar to the underframe construction.

17 Claims, 7 Drawing Sheets

(56) References Cited

U.S. PATENT DOCUMENTS 3,921,537 A * 11/1975 Fleshman ..... B61F 1/02 105/248
4,348,962 A * 9/1982 Smith ..... B61D 7/04 105/248
4,875,417 A * 10/1989 Coulborn ..... B61D 7/00 105/248
5,934,200 A * 8/1999 Lydic ..... B61D 7/02 105/248
6,119,345 A * 9/2000 Lydic ..... B61F 1/02 72/181
6,398,047 B1 * 6/2002 Ladendorf ..... B61G 9/22 213/57
7,856,931 B2 * 12/2010 Gillis ..... B21D 53/88 105/247
8,371,236 B2 * 2/2013 Budnick ..... B61D 3/02 105/404
8,479,661 B2 * 7/2013 Forbes ..... B61D 7/00 105/245
12,179,811 B2 * 12/2024 Gachhadar ..... B61D 3/04
2010/0258031 A1 * 10/2010 Forbes ..... B61F 1/02 105/355
2015/0225001 A1 * 8/2015 Hale ..... B61F 1/08 228/101
2021/0009169 A1 * 1/2021 Wirick ..... B61D 7/02
2022/0371628 A1 * 11/2022 Josephson ..... B61D 7/02
2023/0399031 A1 * 12/2023 Kress ..... B61F 1/02
2024/0391507 A1 * 11/2024 Josephson ..... B61F 1/14

FOREIGN PATENT DOCUMENTS

WO 2019/191762 10/2019
WO WO-2019191762 A1 * 10/2019 ..... B61F 1/02
WO 2022/125974 6/2022

* cited by examiner

FIG. 1
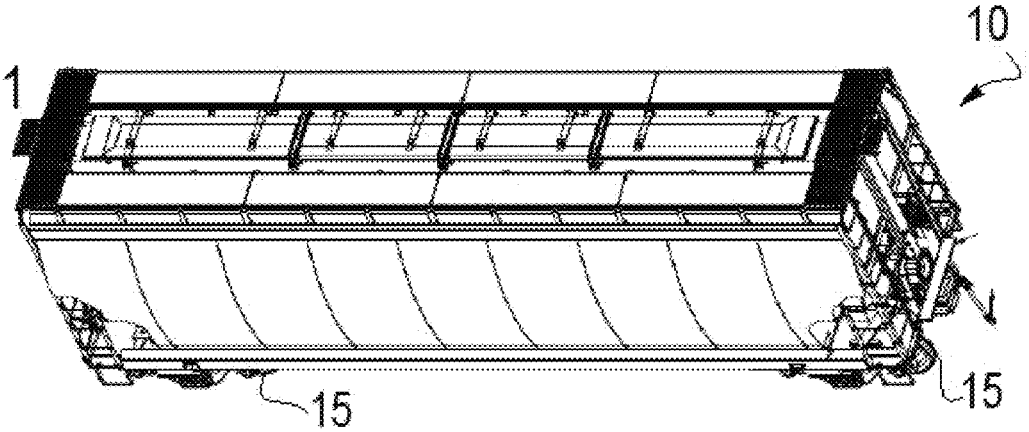
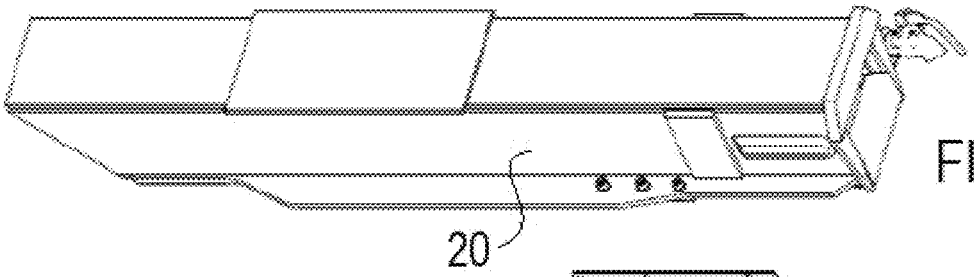
FIG. 2A
FIG. 2B
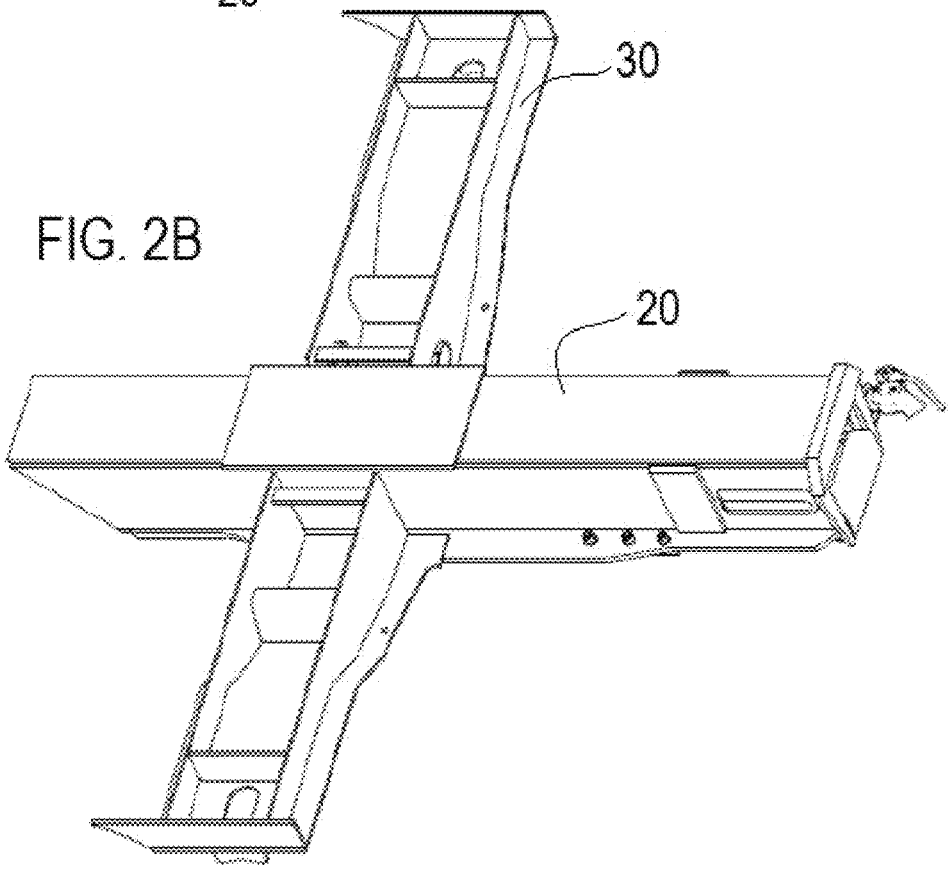

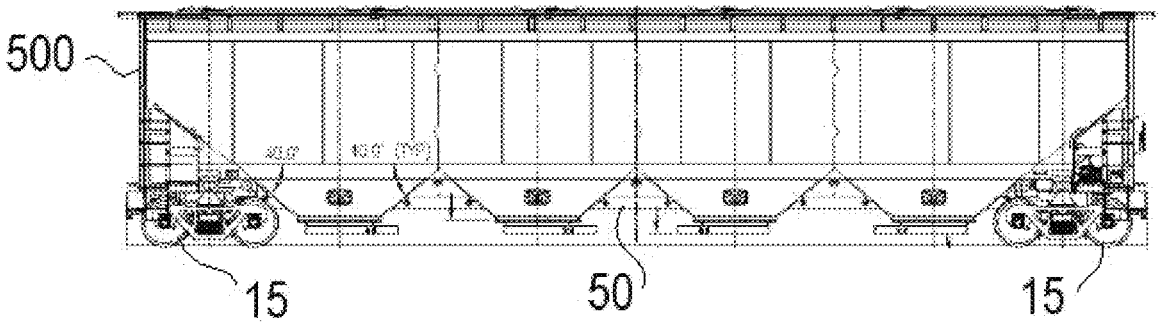
FIG. 4E
FIG. 4F
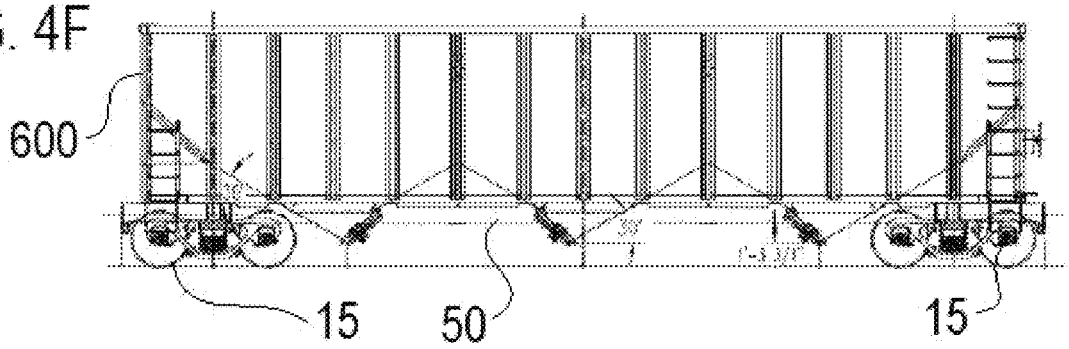
FIG. 4G
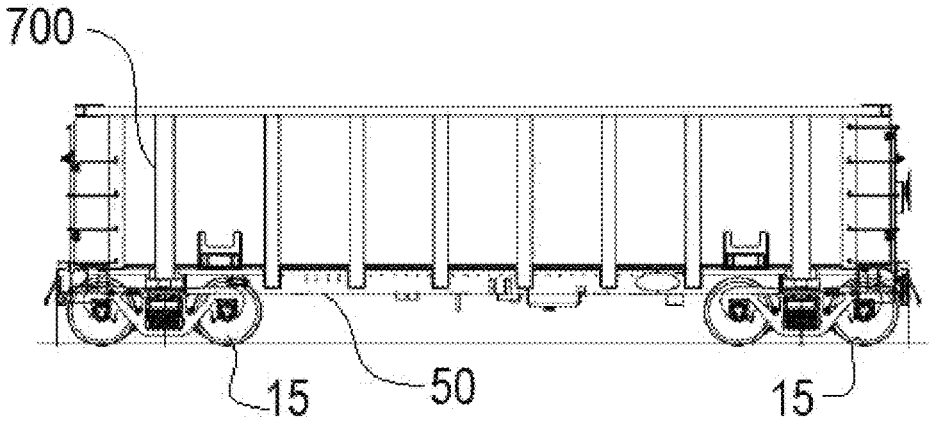

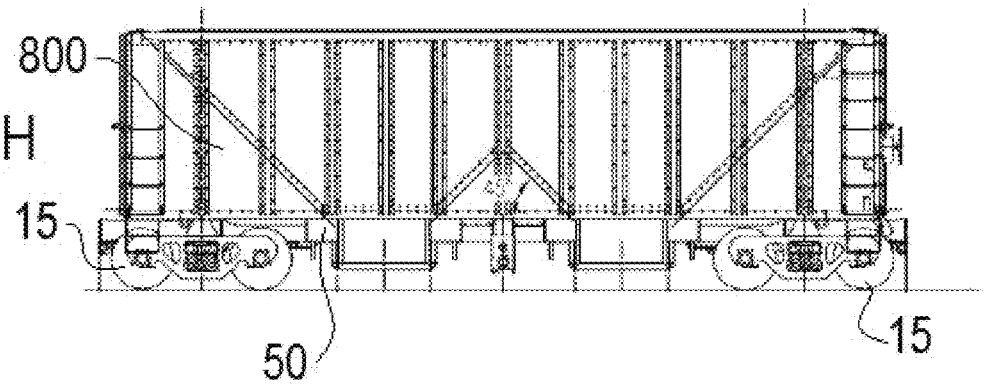
FIG. 4H
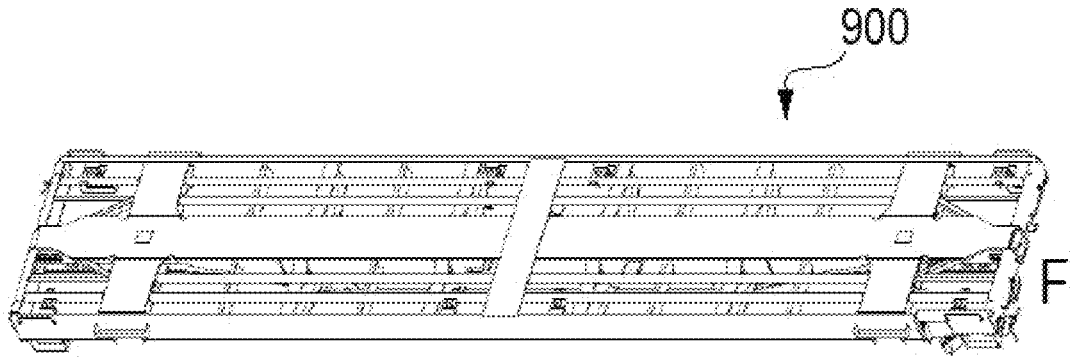
FIG. 5
FIG. 6A
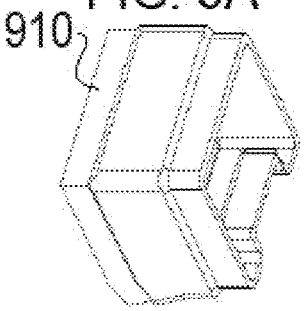
FIG. 6C
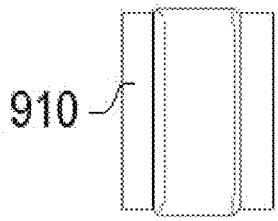
FIG. 6E
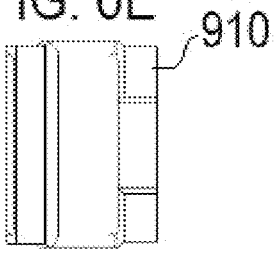
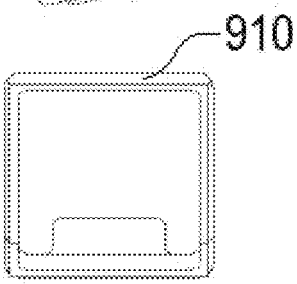
FIG. 6B
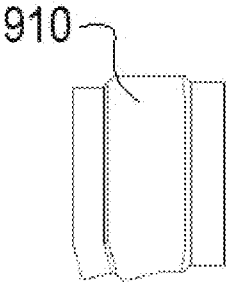
FIG. 6D
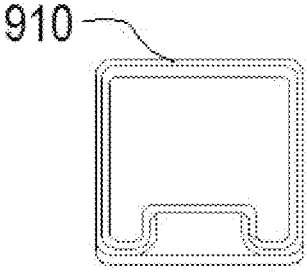
FIG. 6F

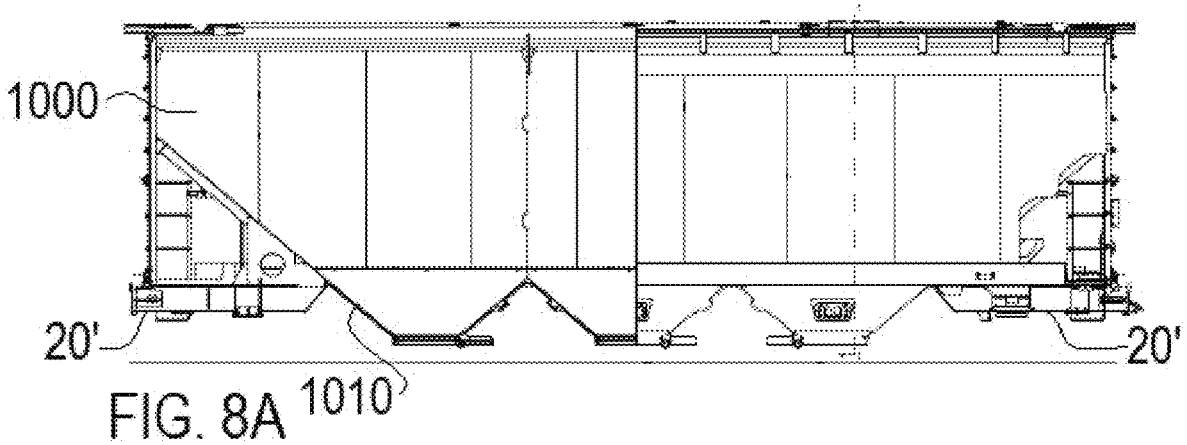
FIG. 8A
FIG. 8B
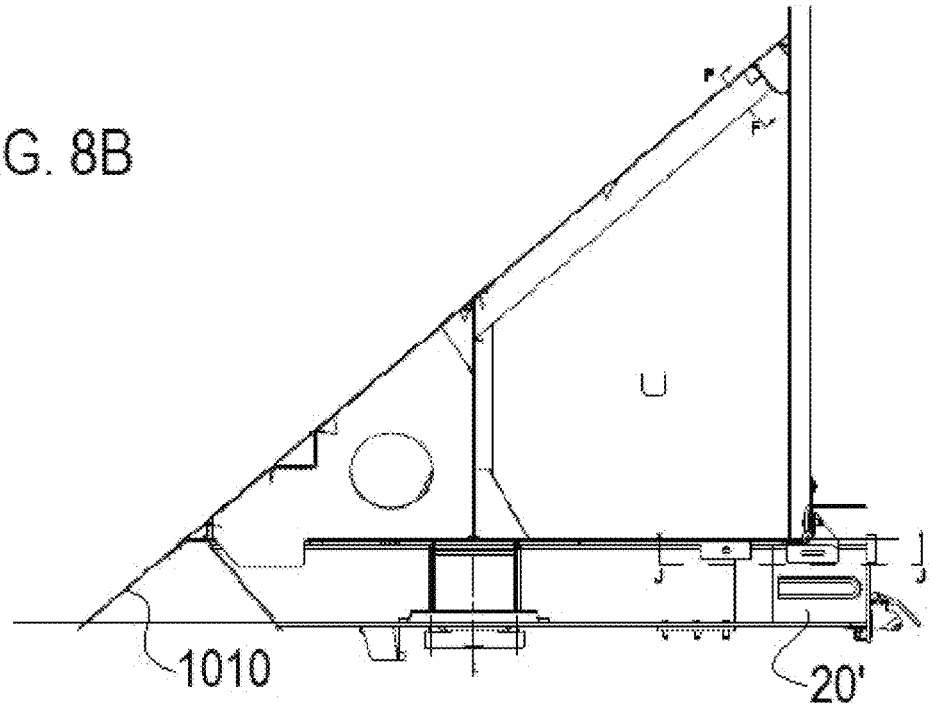

RAIL CAR MODULARIZED MODIFICATION PROGRAMS ALTERING THE NATURE OF THE CENTER SILL IN THE MODIFIED RAILCAR AND THE MODIFIED RAILCARS FORMED THEREBY

RELATED APPLICATIONS

This application is a continuation of International Application Serial Number PCT/US2021/062932 filed Dec. 10, 2021 and which published Jun. 16, 2022 as WO 2022/125974. International Application Serial Number PCT/US2021/062932 claims the benefit of U.S. Provisional Patent Application Ser. No. 63/123,584, filed Dec. 10, 2020 titled "Rail Car Modularized Modification Programs Altering the Nature of The Center Sill in the Modified Railcar and the Modified Railcars Formed Thereby" which is incorporated herein by reference in its entirety.

BACKGROUND OF THE INVENTION

1. Field of the Invention

The present invention relates to railroad car modifications, and more particularly, to a modification programs altering the nature of the center sill and the modified railcars formed thereby.

2. Background Information

In the railroad art, rolling stock has become very specialized with cars specific for transporting automobiles (vehicle carriers), shipping containers (well cars), bulk commodities open top gondola for hauling coal, ballast, coke, wood chips, ore, sand, scrap metal and construction debris, and aggregate, bulk commodities closed top hoppers for hauling grain, sand, cement, potash, soda ash, DDG, and roofing granules, bulk commodities open top hoppers for products similar to open top gondola, tanker cars and more.

Railcars typically have a very long useful life of 50+ years of potential service. However due to changes in the marketplace there can be a large surplus of a given car type. Additionally, the efficiency of newer car types might make a prior car type obsolete before the end of the useful life of the railcar. For example, currently in the United States there is currently a surplus of "sand railcars" defined herein as those originally built primarily for hauling sand and other high density dry bulk products. The boom of the frac industry resulted in a large increase in the rail shipment of specialized sand, known as frac sand. As late as May 2018, the periodical *Railway Age* reported that "In the nonmetallic minerals market, an executive supplying the energy industry described the demand by drillers for fracking sand as "insatiable," adding that only operations issues with Class I railroads was holding back even greater shipment volumes." The railcar industry responded with an increase in the available sand rail cars. A drastic increase in available sand rail cars was met with a similarly drastic decrease in need from frac industry, leading to fleets of underutilized sand rail cars. The types of cars that are in surplus, however, can change and the types of cars that are in need, obviously, also change.

It has been known to repurpose or modification of an older surplus or obsolete car type into a car type that has greater current utility. "Modification" is Association of American Railroads (AAR) defined term (see Office Manual of the AAR Interchange Rules, rule 88(d)(2)) defined as a change to a car that alters capacity of car, or size of car type, or type of lading being hauled. This application uses the terms modification and modify in connection with this rule whereby within this application rail car modification programs reference programs that will modify railcars within the meaning of this AAR rule. The applicants successfully developed a coal car related modification program that is described in WO 2019/191762, which publication is incorporated herein by reference.

Publication WO 98-36957, and U.S. Pat. Nos. 3,238,899 and 8,371,236 are generally relevant to the state of the art of this application.

One problem with the modification programs proposed to date is that the modified railcar maintains the center sill construction of the donor car thereby limiting the available class of modified cars that can be offered from a given donor car. The centers sill, within this application, defines the backbone structure of the car, and is an inclusive term for a variety of structures.

Within the meaning of this application the center sill construction defines the nature of the center sill of class of the center sill. Within the meaning of this application the three classes or distinct natures of center sill constructions are through sills, stub sills, and fish belly sills.

A center sill construction that is a through sill represents a center sill extending the length of the railcar along a single line, and may represent the most common center sill design in the railcar art.

A center sill construction that is a stub sill extend from the ends of the cars only partially, generally past the bolster and then terminates and transmits forces through other structures (side sills, center tanks, etc.) longitudinally along the rail car.

A center sill construction that is a fish belly sill is a longitudinal beam that flares downwardly in the center of the car beyond the trucks. The name fish belly comes from the profile shape of the structure.

In the art "center sill" is sometimes used more narrowly to define a through sill beam and thus an explanation of the broader usage of the phrase "center sill" herein is important to better understand the scope and content of the present invention.

There is a need for effective and efficient modification methodologies for rail cars that better opens the possible modified cars that may be formed.

SUMMARY OF THE INVENTION

It is an object of the present invention to provide for an effective and efficient modification methodologies for rail cars that better opens the possible modified cars that may be formed. The present invention provides a rail car modification programs altering the nature of the center sill in the modified railcar.

One aspect of the present invention provides method of modification of a railcar to form a modified railcar comprising the steps of: providing an existing railcar with a pair of truck assemblies and a center sill design of one of i) a stub sill and ii) a through sill; removing an upper portion of the existing railcar; forming an underframe construction configured to be above the truck assemblies and a center sill design of one of i) a stub sill ii) a through sill, and iii) a fish-belly center sill, wherein the underframe construction has a center sill design different from the center sill design of the donor car; forming an upper body of the modified railcar; and attaching the upper body of the modified railcar to the underframe construction One aspect of the invention provides a method of modification of a railcar to form a modified railcar comprising the steps of: providing an existing railcar with a through center sill design of one of i) a cold formed center sill, ii) a hot rolled center sill and iii) a fabricated center sill; removing an upper portion of the existing railcar; forming an underframe construction including bolsters configured to be above truck assemblies and a center sill design comprising end portions which are of one of i) a cold formed center sill, ii) a hot rolled center sill and iii) a fabricated center sill and a central center sill portion which is one of i) a cold formed center sill, ii) a hot rolled center sill and iii) a fabricated center sill, wherein the central center sill portion type differs from the end portion type; and transition castings transitioning from the end portions to the central portions; forming an upper body of the modified railcar; and attaching the upper body of the modified railcar to the underframe construction.

These and other advantages of the present invention will be clarified in the brief description of the preferred embodiment taken together with the drawings in which like reference numerals represent like elements throughout.

BRIEF DESCRIPTION OF THE DRAWINGS

FIG. 1 is a perspective view of a stub sill donor car for use in one method of modification of a railcar to form a modified railcar according one embodiment of the present invention.

FIGS. 2A-C are perspective views which illustrate the salvaged underframe car components after cut down in the method of modification of a railcar to form a modified railcar using the donor railcar of FIG. 1.

FIGS. 4A-H illustrate the variety of through sill car designs that can be formed as the modified railcar using the fabricated through sill of FIG. 3 and the salvaged underframe car components from the donor railcar of FIG. 1.

FIG. 5 illustrates a fish belly center sill modified car design that can be formed as the modified railcar using the salvaged underframe car components from the donor railcar of FIG. 1 according to an alternative method of the present invention.

FIGS. 6A-F includes a perspective view and six isometric views of a casting used to form the fish belly center sill of the modified railcar of FIG. 5 from the salvaged underframe car components from the donor railcar of FIG. 1.

FIG. 8A illustrates a stub center sill modified car design that can be formed as the modified railcar using the salvaged underframe car components from a through sill donor railcar according to an alternative method of the present invention.

FIG. 8B is a side elevation view of the stub sill-end wall interface in the stub center sill modified car design of FIG. 8A.

DESCRIPTION OF THE PREFERRED EMBODIMENTS

Figure 2C:
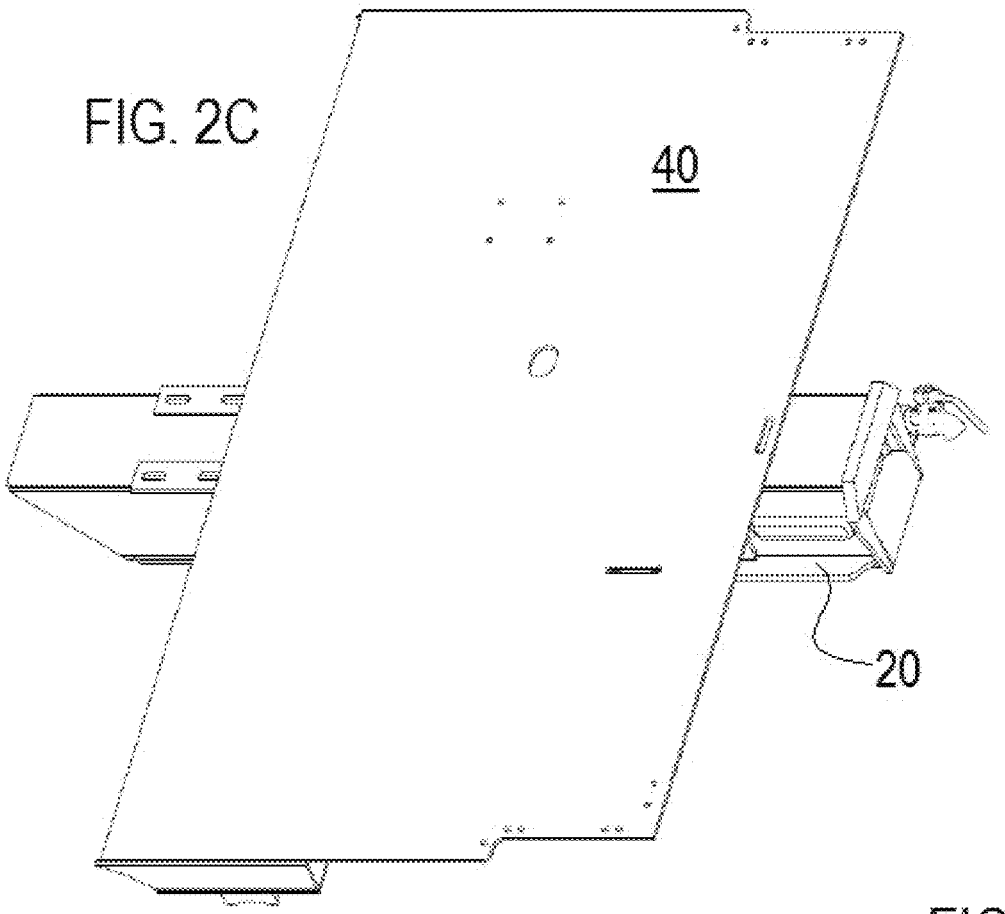

The present invention provides a rail car modularized modification programs altering the nature of the center sill in the modified railcar. The present invention provides method of modification of a railcar to form a modified railcar comprising the steps of: providing an existing railcar 10 with a center sill design of one of i) a stub sill and ii) a through sill; removing an upper portion of the existing railcar 10; forming an underframe construction including bolsters configured to be above truck assemblies 15 and coupled to the center sill design, and a center sill design of one of i) a stub sill ii) a through sill, and iii) a fish-belly center sill; forming an upper body of the modified railcar; and attaching the upper body of the modified railcar to the underframe construction.

FIG. 1, for example, shows a stub sill donor car 10 for use in one method of modification of a railcar to form a modified railcar 100, 200, 300, 400, 500, 600, 700 800 or 900 according one embodiment of the present invention.

The first step of the modification of car according to the present invention is known herein as the cut down or burn down in which the upper portion of the car 10 is removed. The salvaged car components of car 10 are those components that will be reinstalled on the modification railcar 100, 200, 300, 400, 500, 600, 700, 800 or 900 in addition to the trucks 15 and center sill and draft assemblies (draft arm and coupler assemblies—if appropriate), such the brake system component, the draft system components and the truck system components. Other non-reused components of the railcar 10 may be otherwise repurposed or scrapped for salvage.

FIGS. 2A-C illustrate the salvaged underframe car components after cut down in the method of modification of a railcar 10 to form a modified railcar using the donor railcar 10 of FIG. 1. The trucks 15 and accessories that are salvaged are not shown. Specifically, FIG. 2A shows a salvaged stub sill 20 from the donor railcar 10 of FIG. 1, FIG. 2B shows the stub sill 20 and bolster 30, and FIG. 2C shows the stub sill 20 and shear plate 40.

Figure 3:
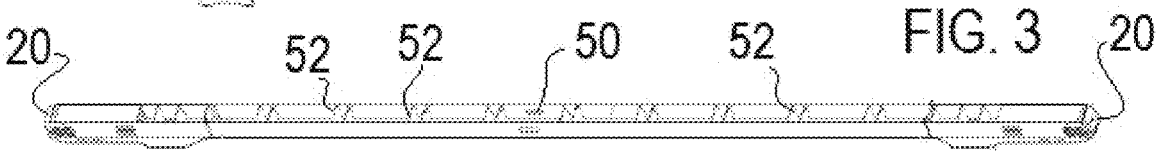
FIG. 3 is a perspective view of a fabricated through type center sill for a modified railcar using the salvaged underframe car components after cut down in the method of modification of a railcar to form the modified railcar using the donor railcar of FIG. 1.

FIG. 3 is a perspective view of a fabricated through type center sill 50 for a modified railcar 100, 200, 300, 400, 500, 600, 700, or 800 using the salvaged underframe car components after cut down shown in FIGS. 2A-C in the method of modification of a railcar 10 to form the modified railcar 100, 200, 300, 400, 500, 600, 700, or 800 using the donor railcar 10 of FIG. 1.

The fabricated through center sill 50 further includes transverse reinforcing webs 52 spaced along the through center sill 50 and within the salvaged stub sills 20 as shown. The coupling of the center sill construction to the salvaged underframe car components sections including the stub sills 20 may be through AAR patch couplings, or more preferably through lightweight transition type or splice type castings similar to those described in WO 2019/191762, which is incorporated herein by reference. However, the most preferred method of forming this coupling of the center sill construction of the formed underframe to the salvaged underframe car components may be through the use of center sill splice contoured backing bars. When using the backing bars for coupling the center sill construction of the formed underframe to the salvaged underframe car components the internal backing bars are provided within the center sill section matching the interior of the structural member which allows for providing a full depth weld through the center sill section along substantially the full perimeter thereof. The coupling with the backing bars may further include overlaying patches, which may allow for compliance with existing AAR splicing protocols, but the patches are not believed to be required for the modified railcar performance.

FIGS. 4A-H illustrate the variety of through sill car designs 100, 200, 300, 400, 500, 600, 700, or 800 that can be formed as the modified railcar 100, 200, 300, 400, 500, 600, 700, or 800 using the fabricated through sill 50 of FIG. 3 and the salvaged underframe car components including the stub sill 20 from the donor railcar 10 of FIG. 1. In practice a fleet operator with excess donor cars 10 such as the type shown in FIG. 1 can select which of the modified railcar types 100, 200, 300, 400, 500, 600, 700, or 800 of FIGS. 4A-H can be most effectively placed into service and the process proceed to form the desired car 100, 200, 300, 400, 500, 600, 700, or 800. After the through type center sill 50 of FIG. 3 is constructed the upper body of the final designated car type 100, 200, 300, 400, 500, 600, 700, or 800 of FIGS. 4A-H is built and the repurposed accessories added accordingly. The method of the present invention is to provide a greater variety of potential service cars to the customer for the resulting modified railcar 100, 200, 300, 400, 500, 600, 700, or 800. The end result is to take a railcar 10 that is out of service and costing money for storage and return a railcar 100, 200, 300, 400, 500, 600, 700, or 800 to useful operation.

Naturally, the modified railcar 100, 200, 300, 400, 500, 600, 700, or 800 costs significantly less to produce than a new car having the particulars of the modified railcar 100, 200, 300, 400, 500, 600, 700, or 800. Furthermore in the formation of any given modified railcar 100, 200, 300, 400, 500, 600, 700, or 800 there may be more salvaged or repurposed components from the donor car 10 that may be reused in the modified railcar 100, 200, 300, 400, 500, 600, 700, or 800. The present invention is primarily focused on the center sill structure as this is the backbone of the car 100, 200, 300, 400, 500, 600, 700, or 800. Finally there may be components from the original donor railcar 10 that are repurposed for use in cars other than the modified railcar 100, 200, 300, 400, 500, 600, 700, or 800, such as replacement parts for the original donor car type. Repurposing onto the modified railcar 100, 200, 300, 400, 500, 600, 700, or 800 or onto other railcars is generally preferred, when economical, to scrapping.

Figure 4A:
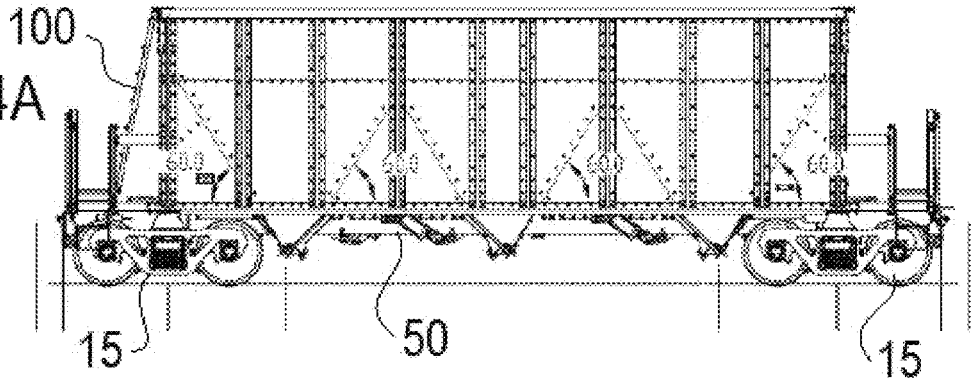
Figure 4B:
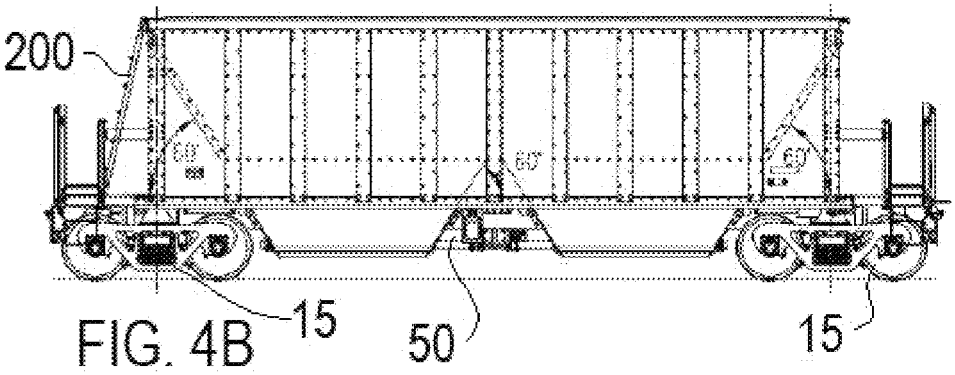
Figure 4C:
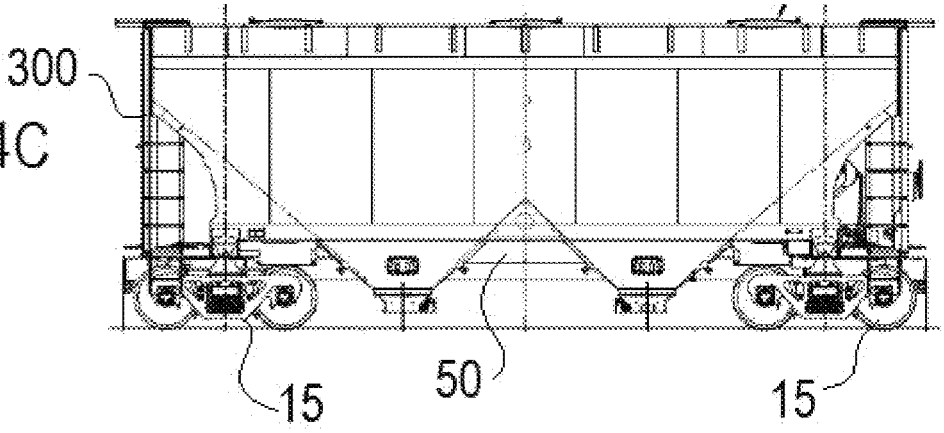
Figure 4D:
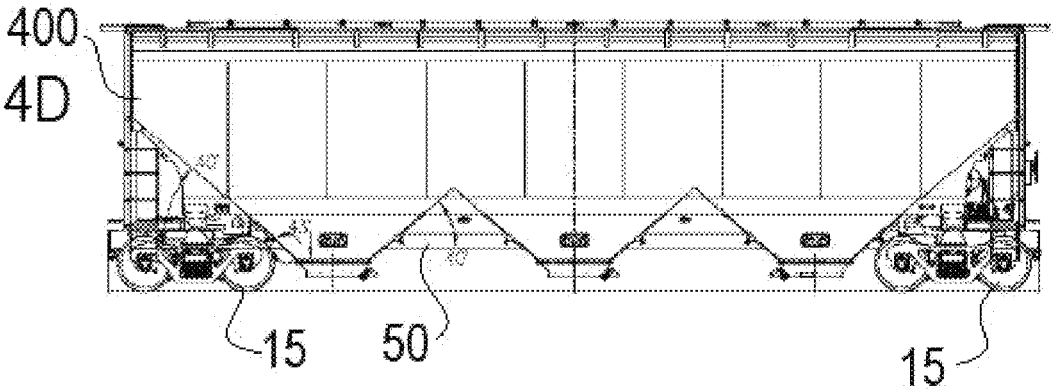

Returning to the available car types for the method of the present invention beginning with the donor car 10 of FIG. 1, FIG. 4A is a three hopper transverse hopper car 100, FIG. 4B is a longitudinal hopper aggregate car 200; FIG. 4C is a covered double hopper car 300; FIG. 4D is a covered triple hopper car 400; FIG. 4E is a covered quad hopper car 500; FIG. 4F is a transverse hopper coal car 600; FIG. 4G is an aggregate gondola car 700; and FIG. 4H is a ballast car 800. The dimensions within each of these car types 100, 200, 300, 400, 500, 600, 700, or 800 may be varied to accommodate specific range of lading types or other designated operating parameters as generally known in the art.

Figure 7A:
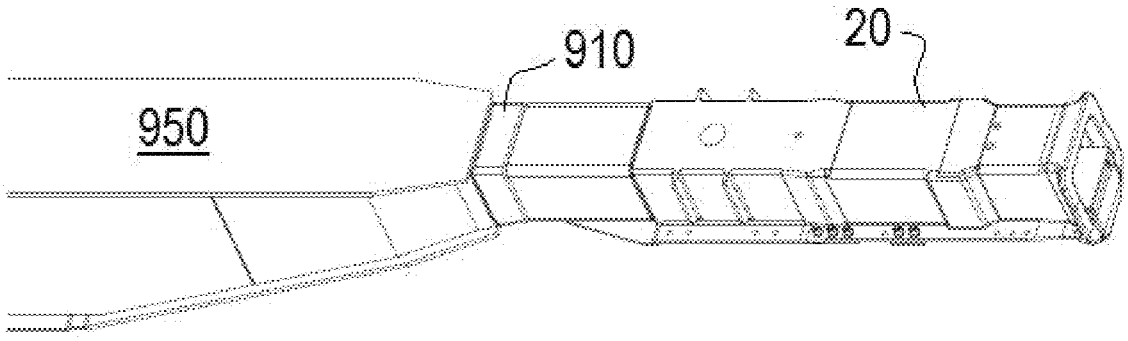
FIG. 7A is a top view of one end of the fish belly center sill design of the modified railcar of FIG. 5 from the salvaged underframe car components from the donor railcar of FIG. 1.
Figure 7B:
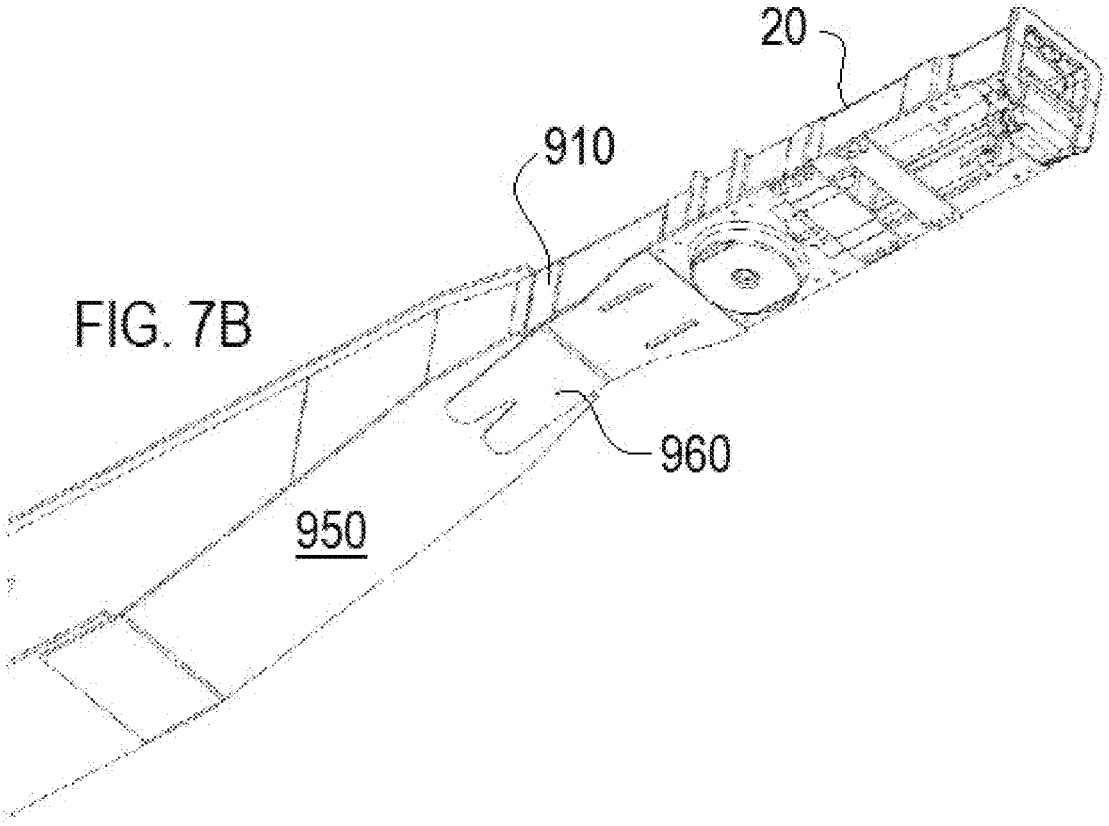
FIG. 7B is a bottom view of one end of the fish belly center sill design of the modified railcar of FIG. 5 from the salvaged underframe car components from the donor railcar of FIG. 1.

FIG. 5 illustrates a fish belly center sill modified car design 900 that can be formed as the modified railcar 900 using the the salvaged underframe car components including the stub sill 20 from the donor railcar 10 of FIG. 1 according to an alternative method of the present invention. FIGS. 7A and 7B illustrate the fish belly center sill design 950 of the modified railcar 900 of FIG. 5 from the salvaged underframe car components including the stub sill 20 from the donor railcar 10 of FIG. 1. This design of railcar 900 utilizes a casting 910 illustrated in FIGS. 6A-F to transition from the stub sill 20 of the salvaged underframe car components of FIG. 2A-C to a conventional fabrication of the fish belly center sill 950 as shown. After forming the fish belly center sill 950 using two castings 910 and the stub sills 20 that are salvaged from the donor car, a support plate 960 can be coupled that overlaps the casting 910 position. Then the upper body is attached to the fish belly center sill 950 to form the car 900 of FIG. 5. The fish belly center sill 950 design option again expands the options when starting with the donor car 10 of FIG. 1.

As discussed above, the applicants successfully developed a coal car related modification program that is described in WO 2019/191762, which is incorporated herein by reference. In this prior art modification program the donor cars were through sill center sill constructions that were converted to alternative through sill constructions as detailed therein. The present invention is related to modification programs altering the nature of the center sill in the modified railcar and this methodology can apply to through sill donor cars such as of the type discussed in WO 2019/191762. The existing through sill donor cars will have one of i) a cold formed center sill, ii) a hot rolled center sill and iii) a fabricated center sill and can be made into the modified cars 100, 200, 300, 400, 500, 600, 700, or 800 by removing an upper portion of the existing railcar; forming an underframe construction including bolsters configured to be above truck assemblies and a center sill design comprising end portions which are of one of i) a cold formed center sill, ii) a hot rolled center sill and iii) a fabricated center sill from the donor car and a central center sill portion which is one of i) a cold formed center sill, ii) a hot rolled center sill and iii) a fabricated center sill, wherein the central center sill portion type differs from the end portion type. The method here uses a transition castings transitioning from the end portions to the central portions. The railcars 100, 200, 300, 400, 500, 600, 700, or 800 are completed by forming an upper body of the modified railcar; and attaching the upper body of the modified railcar to the underframe construction.

FIG. 8A illustrates a stub center sill modified car design 1000 that can be formed as the modified railcar using the salvaged underframe car components from a through sill donor railcar according to an alternative method of the present invention.

The cut down or burndown of the through sill railcar is similar to that described above (and analogous to that described in WO 2019/191762) wherein the center sill is cut down to form two stub sills 20' as shown in FIGS. 8A and 8B. In this method of the present invention the modified railcar 1000 is a stub sill hopper railcar 1000 having two slopping end sheets 1010 for the end hoppers. The stub sill 20' is cut to form an angle that is substantially perpendicular (+/−10 degrees) to the angle of the end sheet 1010. The salvaged "stub sill" 20' has a plate added as shown along the cut line that is substantially perpendicular to the floor sheet 1010 and engages with a transverse floor support on the floor sheet. This arrangement allows the forces to be transferred through the stub sill 20' and then through the cross bracing to the side sill structure, and allows the effective formation of the stub sill 20' design. This option is to give greater flexibility to the finished modified railcar when starting from a through sill donor car. Essentially a customer with an idle through sill car can adopt a modification program that bests suits its needs and select any of the modified rail cars shown in the applicant's prior method of WO 2019/191762 or now select a stub sill hopper car 1000 design of FIGS. 8A and B of the present invention. The number of hoppers in the modified railcar 1000 is shown as three and will generally be preferred for most laden types, however this modification can easily accommodate one, two or four hoppers as desired without altering the general method.

The rail car modularized modification programs altering the nature of the center sill in the modified railcar 100, 200,

300, 400, 500, 600, 700, 800, 900 or 1000 as described above yield a greater variety of car types 100, 200, 300, 400, 500, 600, 700, 800, 900 or 1000 that can be placed into service from idle railcars 10.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention should be defined by the appended claims and equivalents thereto.

What is claimed is:

1. A method of modification of a railcar to form a modified railcar comprising the steps of:

Providing an existing donor railcar with a pair of truck assemblies and a center sill design of one of i) a stub sill and ii) a through sill;

Removing an upper portion of the existing donor railcar;

Forming an underframe construction configured to be above the truck assemblies and having a center sill design of one of i) a stub sill ii) a through sill, and iii) a fish-belly center sill, wherein the underframe construction has a center sill design of one of a through sill and a fish-belly center sill when the center sill design of the existing donor railcar is a stub sill, and wherein the underframe construction has a center sill design of one of a stub sill and a fish-belly center sill when the center sill design of the existing donor railcar is a through sill;

Forming an upper body of the modified railcar; and

Attaching the upper body of the modified railcar to the underframe construction.

2. The method of modification of a railcar to form a modified railcar according to claim 1 wherein the existing donor railcar includes a stub sill center sill design.

3. The method of modification of a railcar to form a modified railcar according to claim 2 wherein the forming of the underframe construction includes using a salvaged stub sill, bolster and shear plate from the existing donor railcar.

4. The method of modification of a railcar to form a modified railcar according to claim 2 wherein the forming of the underframe construction includes forming a through sill center sill design.

5. The method of modification of a railcar to form a modified railcar according to claim 4 wherein the forming of the underframe construction having a center sill design includes forming a fabricated through center sill.

6. The method of modification of a railcar to form a modified railcar according to claim 5 wherein the fabricated through center sill further includes transverse reinforcing webs spaced along the through center sill.

7. The method of modification of a railcar to form a modified railcar according to claim 6 wherein the fabricated through center sill further includes transverse reinforcing webs within the salvaged stub sills.

8. The method of modification of a railcar to form a modified railcar according to claim 4 wherein the modified railcar is one of a three hopper transverse hopper car, a longitudinal hopper aggregate car, a covered double hopper car, a covered triple hopper car, a covered quad hopper car, a transverse hopper coal car, an aggregate gondola car, and a ballast car.

9. The method of modification of a railcar to form a modified railcar according to claim 2 wherein the forming of the underframe construction includes forming a fish-belly center sill.

10. The method of modification of a railcar to form a modified railcar according to claim 1 wherein the existing donor railcar includes a through sill center sill design.

11. The method of modification of a railcar to form a modified railcar according to claim 10 the forming of the underframe construction includes forming a stub sill center sill.

12. The method of modification of a railcar to form a modified railcar according to claim 11 wherein the modified railcar is a stub sill hopper railcar having two sloping end sheets for the end hoppers.

13. A method of modification of a railcar to form a modified railcar comprising the steps of:

Providing an existing donor railcar with a pair of truck assemblies and a center sill design of one of i) a stub sill and ii) a through sill;

Removing an upper portion of the existing donor railcar;

Forming an underframe construction configured to be above the truck assemblies and having a center sill design of i) a stub sill when the center sill design of the existing donor car is a through sill and ii) a through sill when the center sill design of the existing donor car is a stub sill;

Forming an upper body of the modified railcar; and

Attaching the upper body of the modified railcar to the underframe construction.

14. The method of modification of a railcar to form a modified railcar according to claim 13 wherein the existing donor railcar includes a stub sill center sill.

15. The method of modification of a railcar to form a modified railcar according to claim 14 wherein the forming of the underframe construction includes using a salvaged stub sill, bolster and shear plate from the existing donor railcar.

16. The method of modification of a railcar to form a modified railcar according to claim 14 wherein the forming of the underframe construction includes forming a through sill center sill.

17. The method of modification of a railcar to form a modified railcar according to claim 16 wherein the forming of the underframe construction having a center sill design includes forming a fabricated through center sill.

* * * * *